US005183003A

United States Patent [19]

Powell et al.

[11] Patent Number: 5,183,003

[45] Date of Patent: Feb. 2, 1993

[54] HANDWORN MECHANISM FOR SIGNALLING BY SCUBA DIVERS

[76] Inventors: Bruce W. Powell; Judith F. Powell, both of 1442 G St., Woodbridge, Va. 22191

[21] Appl. No.: 804,724

[22] Filed: Dec. 11, 1991

[51] Int. Cl.[5] ..... B63B 45/08; H04B 11/00

[52] U.S. Cl. ..... 116/26; 2/160; 367/141

[58] Field of Search ..... 116/26, 27, 67 R; 2/161 A; 441/58; 405/186; 367/141

[56] References Cited

U.S. PATENT DOCUMENTS

| | | | |
|---|---|---|---|
| 2,736,034 | 2/1956 | Fredenhagen et al. | 2/163 X |
| 4,326,706 | 4/1982 | Guthrie et al. | 2/160 X |
| 4,586,387 | 5/1986 | Morgan et al. | 2/160 X |
| 4,635,516 | 1/1987 | Giannini | 2/160 X |
| 4,761,835 | 8/1988 | Chen | 2/160 |
| 4,858,204 | 8/1989 | Holston et al. | 116/26 X |
| 4,923,418 | 5/1990 | Hoffman | 441/58 X |
| 5,003,637 | 4/1991 | Lonon | 2/160 |

*Primary Examiner*—Daniel M. Yasich
*Attorney, Agent, or Firm*—Larson and Taylor

[57] ABSTRACT

A hand worn signalling mechanism for use in scuba diving includes a flexible article which is designed to be worn on a hand of the user. A striker is mounted by a mounting means to the flexible article adjacent the palm of the user. The user easily and quickly produces a percussive sound upon striking of an air tank also worn by the user with the striker. In a preferred embodiment, the flexible article is loosely mounted adjacent to the palm of the user with a backer underneath and such that the striker is laterally adjacent a center of the palm and longitudinally between the center and a distal end of the palm. Preferably, this is accomplished by making the striker as a cylinder with a longitudinal aperture, and then the mounting means is a flexible member (loop or strap) passing through the longitudinal aperture and secured to the flexible article. In one preferred embodiment, the flexible article is a glove, while in another embodiment the flexible article is a band. According to a method for signalling, the striker is first attached to a flexible article. This article is then worn by the user while diving with the striker positioned in a distal area of the palm. Signalling is then accomplished by simply moving the hand so that the striker taps against the tank worn by the user.

20 Claims, 2 Drawing Sheets

HANDWORN MECHANISM FOR SIGNALLING BY SCUBA DIVERS

FIELD OF THE INVENTION

The present invention relates generally to the field of underwater diving, and more particularly to the field of signalling from one diver to another while under water.

BACKGROUND OF THE INVENTION

While diving under water, it is frequently desired to communicate with another diver. In the absence of expensive and sophisticated equipment, such communication typically involves hand signals. But in order to convey a message in this manner, it is first necessary to get the other diver's attention. This is frequently a problem if the other diver is not looking at the diver wishing to convey the message, or at least in his general direction, and this is particularly a problem in situations where visibility is limited.

When one diver wishes to get the attention of another, the first diver will typically reach down and unbuckle a knife carried adjacent the ankle or the like. Using the knife, the first diver will then rap on the air tank attached to his back to produce a percussive sound which is easily heard by any nearby diver. The percussive sound produced is also not natural, so that the other diver is alerted that someone is trying to get their attention. In addition, the other diver also gets some sense of the direction from which the sound originated.

While such a sound producing system is effective, it suffers from a number of disadvantages. For example, the reaching for and grasping of the knife is time consuming, so that if the attention of the other diver is required immediately (i.e., to see something which may swim away), it may be too late once this form of communication is accomplished. In addition, in unbuckling of the knife from its holster on the ankle, the knife is subject to being accidentally dropped. Dropping of the knife not only prevents communication, but the knife itself may be irretrievable or lost.

SUMMARY OF THE INVENTION

In accordance with the present invention, a hand worn signalling mechanism is provided which overcomes the problems of the prior art. The signalling mechanism of the present invention includes a flexible article which is designed to be worn on a hand of the user/diver. This flexible article extends at least across a portion of a palm of the hand. A striker is mounted by a mounting means to the flexible article adjacent the palm of the user. When worn by the user, the user easily and quickly produces a percussive sound by striking of the striker against an air tank also worn by the user.

In a preferred embodiment, the flexible article is mounted adjacent to the palm of the user such that the striker is laterally adjacent a center of the palm and longitudinally between the center and a distal end of the palm. This locates the striker in the vicinity of the transverse fasciculi of the underlying hand.

In the preferred embodiment, the striker is made of a corrosion resistant, hard metal, such as stainless steel. Beneath the striker, on the other side of the flexible article, is a hard backer. In addition, the mounting means mounts the striker to the flexible article such that the striker is loosely held to the flexible article. Preferably, this is accomplished by making the striker as a cylinder with a longitudinal aperture, and then the mounting means is a flexible member (loop or strap) passing through the longitudinal aperture and secured to the flexible article.

In one preferred embodiment, the flexible article is a glove, while in another preferred embodiment the flexible article is a band.

The present invention also encompasses a method for signalling using a hand worn mechanism such as described above. According to the method, the striker is first attached to a flexible article. This article is then worn by the user while diving with the striker positioned in a distal area of the palm. Signalling is then accomplished by simply moving the hand so that the striker taps against the tank worn by the user. Preferably, the striker is loosely attached to the article.

It is an advantage of the present invention that a mechanism and method for quickly and easily signalling is provided for a diver.

It is also an advantage of the present invention that the signalling mechanism is not subject to being lost by the diver.

It is a further advantage of the present invention that the striker is worn in an out of the way place, so the diver may still use his hands in the normal way but in a location which makes the striker easy to use.

It is still another advantage of the present invention that the striker is located at a position on the palm which is not easily hurt or painful when the striker is used to tap on the tank.

Other features and advantages of the present invention are stated in or apparent from detailed descriptions of presently preferred embodiments of the invention found hereinbelow.

DETAILED DESCRIPTION OF THE PREFERRED EMBODIMENTS

Figure 1:
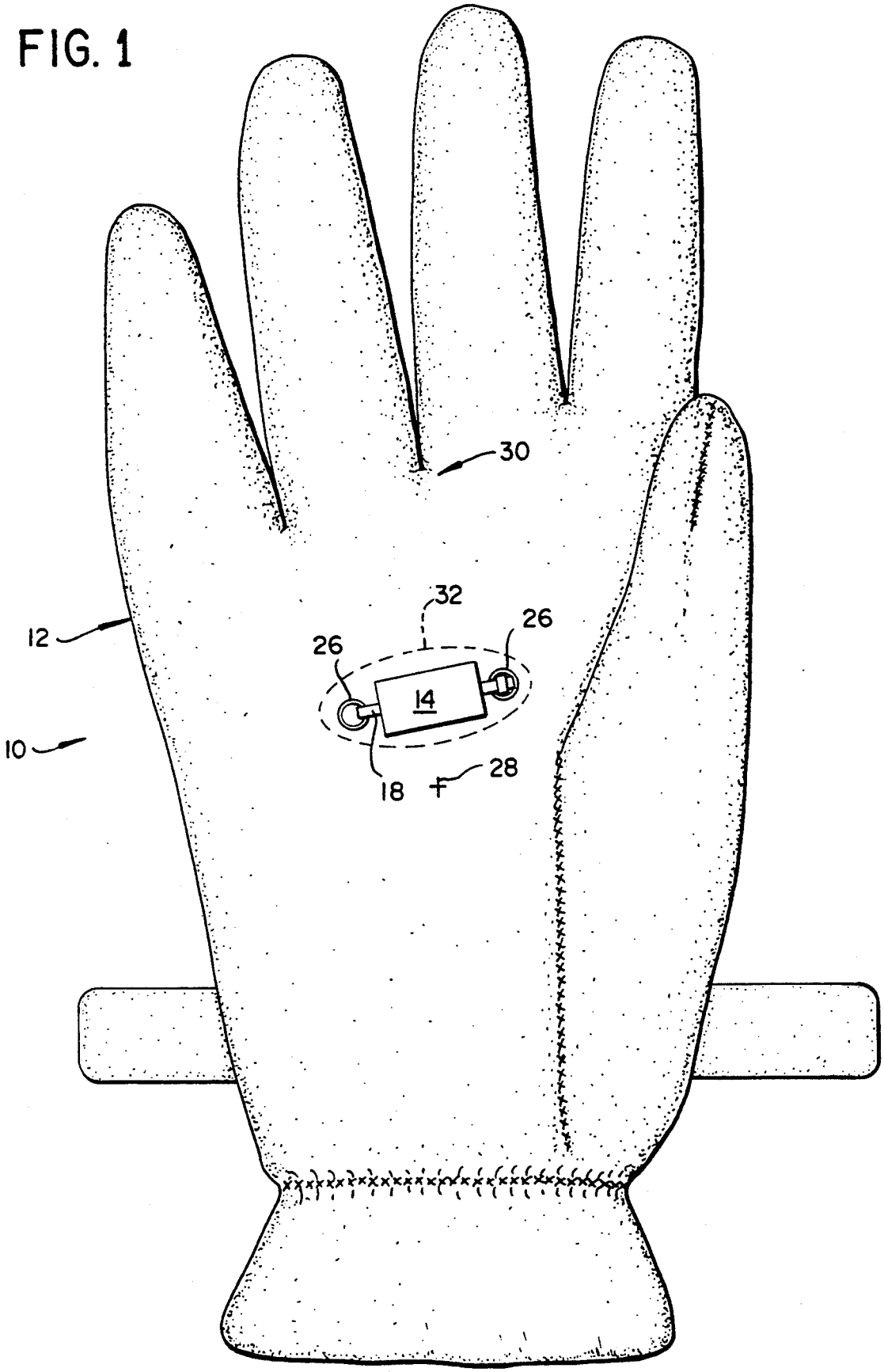
FIG. 1 is a front plan view of a first embodiment of the present invention including a glove provided with a striker.
Figure 2:
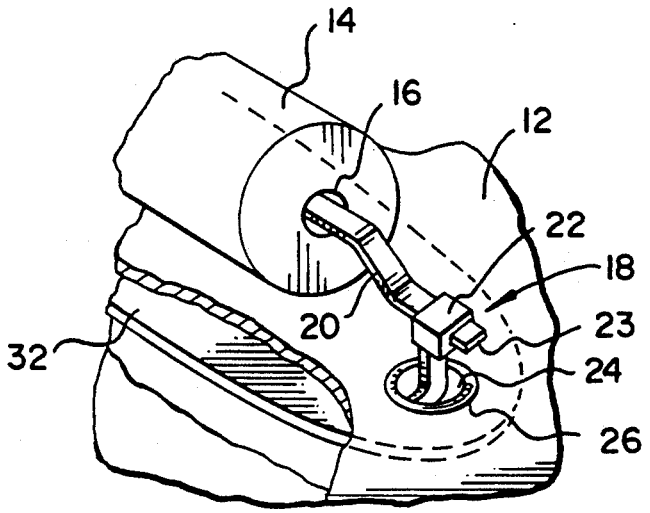
FIG. 2 is an enlarged perspective view of a portion of the glove and striker depicted in FIG. 1.

With reference now to the drawings in which like numerals represent like elements throughout the views, a first embodiment of a hand worn signalling mechanism 10 is depicted in FIGS. 1 and 2. Signalling mechanism 10 includes a flexible article which is designed to be worn on a hand of the user, and in this embodiment the flexible article is a glove 12. Glove 12 is a usual diver's glove made of vinyl impregnated cotton or other suitable material and typically worn to protect the hands of the diver (especially where coral is present). As is typical of such gloves, glove 12 is gathered at a proximal end thereof and includes opposed straps secured at the sides of glove 12 and attached together across the back of the glove using complementary VELCRO elements to hold glove 12 on the hand of the user.

Attached to glove 12 is a striker 14. Striker 14 is made of a hard material so that when striker 14 is tapped or struck against the side of an air tank, a sharp percussive sound is produced. As striker 14 will be subject to corrosive attack by water, especially sea water, striker 14 is preferably also made of a non-corrosive or corrosion resistant material. Thus, suitable materials for striker 14 includes certain ceramics, other rock-like materials, hard plastics, and especially some metals. An especially preferred material is stainless steel, due to its ready availability, resistance to rust or corrosion, and hardness.

In this preferred embodiment, striker 14 is formed as a cylinder with a central longitudinal aperture 16 therethrough. Then, this striker 14 is mounted or attached to glove 12 by a suitable mounting means 18. Mounting means 18 in this embodiment includes a flexible member 20 which is looped through glove 12. Conveniently, as shown, flexible member 20 is a flat nylon tie having a trapping member 22 at one end in which the other end 23 is received. Other end 23 is capable of advancing through trapping member 22 easily, but other end 23 is securely held against a reverse movement by trapping member 22 as well known to those of ordinary skill in the art. After other end 23 is advanced through trapping member 22 to properly hold striker 14 in position, the portion of other end 23 extending beyond trapping member 22 is preferably cut off so that it will not be in the user's way.

Flexible member 20 passes through respective apertures 24 of eyelets 26 provided in glove 12. Eyelets 26 are self attached to glove 12 in the usual manner and are used to prevent flexible member 20 from tearing glove 12. As the material of glove 12 is flexible, it should be appreciated that flexible member 20 is not pulled tight because to do so would merely gather glove 12 at that point. In addition, by not pulling flexible member 20 tight, striker 14 is thus loosely attached to glove 12 and allowed some movement. Consequently, striker 14 is capable of some accommodating movement to one side or the other if the user tries to grasp something, so that striker 14 does not hinder such a grasping.

It will also be appreciated that striker 14 is (loosely) located in a particular location of glove 12. This location is: laterally (left to right), approximately centrally of the palm when glove 12 is worn; and longitudinally (parallel to the fingers), between a center 28 of the palm of the user of glove 12 and a distal end 30 of the palm portion of glove 12. This location thus overlies the approximate location of the transverse fasciculi of the user.

Striker 14 is particularly located on glove 12 for a number of reasons. One reason for this specific location is that when the user does try to grasp something, striker 14 is out of the way to a certain extent of the area (on the proximal half of the palm) where pressure will most frequently be applied. In addition, when the user does tap or rap striker 14 against an air tank, this area of the hand is less susceptible to being hurt by the force (and repeated force) of striker 14 hitting thereagainst (compared with other areas of the palm). Finally, this area is also easy for the user to present to the air tank in order to produce a percussive sound by the tapping of striker 14 thereagainst.

The method of use of the present invention is quite easy. Initially, the diver must obtain a suitable article such as glove 12 with a striker 14 such as described above attached thereto. Striker 14 is attached so that when the diver wears the article or glove 12, striker 14 is positioned in near the center or at a more distal area of the palm of the user. Then, striker 14 is maintained in a relatively out of the way place until the diver wishes to signal someone with a sharp sound. When this occurs, the diver simply reaches behind with the hand to which an exposed portion of the striker 14 is attached and taps or raps striker 14 against his air tank. This produces a sharp percussive sound which is easily heard by nearby divers.

In order to increase the percussive sound produced when striker 14 is tapped against an air tank, it may be desirable to provide a backer 32 behind striker. Thus, as depicted in FIGS. 1 and 2, backer 32 is located inside of glove 12 between the palm of the user and the material of glove 12. Preferably, backer 32 is made of a hard material to help in sound production, such as a metal and in particular the metal of striker 14 (for the same considerations). Conveniently, backer 32 is simply attached to glove 12 by eyelets 26 which pass therethrough as well as through glove 12. It should be appreciated that the presence of backer 32 not only amplifies the sound produced, but backer 32 also serves to spread out the force produced on the palm when striker 14 is tapped against the air tank to further reduce the possibility of hurting the palm even by repeated uses of striker 14.

Figure 3:
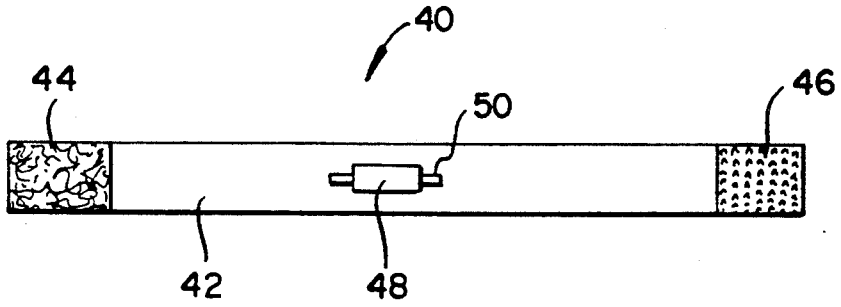
FIG. 3 is a front plan view of a second embodiment of the present invention including a flexible band provided with a striker.

Depicted in FIG. 3 is an alternative embodiment of a hand worn signalling mechanism 40. In this embodiment, signalling mechanism 40 includes a flexible article in the form of a band 42. Band 42 has respective ends provided with complimentary VELCRO attachment members 44 and 46. Thus, it will be appreciated that band 42 is adjustably attachable about the palm of the user by simply bringing complementary members 44 and 46 together.

Attached approximately in the middle of band 42 is a striker 48. Striker 48 is substantially the same as striker 14 described above, and thus striker 48 is attached to band 42 by a flexible member 50. Conveniently, flexible member 50 in this embodiment is simply attached to band 42 as by sewing or the like, and thus flexible member 50 does not form a loop as did flexible member 20 discussed above. However, striker 46 is still loosely attached to band 42 in a manner similar to striker 14 discussed above.

In use, hand worn signalling mechanism 40 is used in a manner similar to signalling mechanism 10 discussed above. Thus, band 42 is attached to the hand of the user so that striker 48 is located adjacent the palm of the user, and preferably at a distal side of the center of the palm. Then, when signalling is desired, the user simply taps or strikes striker 48 against the air tank as with the first embodiment described above.

It should be appreciated that although specific constructions of the present invention have been described, various other constructions are possible. For example, while the striker has been described as being a certain cylindrical element, other shapes and sizes would be possible which would perform the same function. Examples of such shapes include round, rectangular or other regular rods, or a plurality of such shapes strung together.

In addition, other means of attaching the striker to the article would also be possible, and if desired need not be made to loosely attach the striker. Such attachment means could even be removable, if desired. For example, the striker could be secured to one of a complementary pair of VELCRO attachments with the other secured to an appropriate location on the flexible article. In this manner, the striker could be attached, or left off, as desired. And if such a striker were accidentally torn off, it could be easily and cheaply replaced.

Further, while a glove is probably the most universally usable article to which the striker could be attached, various other articles besides the glove and band disclosed could be used to mount the striker in the palm of the hand. For example, simple straps, even fitting between the fingers and wrist, or other finger mounted articles could be used so long as these are not cumbersome and locate the striker in the desired position.

Thus, while the present invention has been described with respect to exemplary embodiments thereof, it will be understood by those of ordinary skill in the art that variations and modifications can be effected within the scope and spirit of the invention.

We claim:

1. A hand worn mechanism used in scuba diving by an underwater user wearing an air tank for producing a sound using the air tank as a percussive instrument comprising:

a flexible article worn on a hand of the user which extends at least across a portion of a palm of the hand;

a hard striker; and a mounting means for mounting said strike to said flexible article adjacent the palm of the user and with at least a top portion of said striker exposed whereby the user easily produces a percussive sound by direct striking of the air tank worn by the user with said striker worn on the hand of the user.

2. A mechanism as claimed in claim 1 wherein said flexible article is mounted adjacent to the palm of the user such that said striker is laterally adjacent a center of the palm and longitudinally between a position near the center and a distal end of the palm.

3. A mechanism as claimed in claim 2 wherein said striker is made of a corrosion resistant, hard metal.

4. A mechanism as claimed in claim 3 wherein said mounting means mounts said striker to said flexible article such that said striker is loosely held to said flexible article.

5. A mechanism as claimed in claim 4 and further including a hard backer attached to an opposite side of said flexible article adjacent said striker.

6. A mechanism as claimed in claim 5 wherein said striker is shaped as a cylinder with a longitudinal aperture, and wherein said mounting means includes a flexible member passing through said longitudinal aperture and secured to said flexible article.

7. A mechanism as claimed in claim 6 wherein said flexible article is a glove.

8. A mechanism as claimed in claim 6 wherein said flexible article is a band.

9. A mechanism as claimed in claim 1 wherein said striker is shaped as a cylinder with a longitudinal aperture, and wherein said mounting means includes a flexible member passing through said longitudinal aperture and secured to said flexible article; and further including a hard backer attached to an opposite side of said flexible article adjacent said striker.

10. A glove which is used by a user when scuba diving with an air tank comprising:

a palm portion which covers a palm of a user;

a hard striker; and a mounting means for mounting said striker to said palm portion with at least a top portion of said striker exposed whereby the user easily produces a percussive sound by direct striking of the air tank with said striker.

11. A glove a claimed in claim 10 wherein said striker is attached to said palm portion laterally in a center thereof and longitudinally between the center thereof and a distal end thereof.

12. A glove as claimed in claim 11 wherein said striker is located on said palm portion at a position to overlie a region in the palm of the user containing transverse fasciculi.

13. A glove as claimed in claim 10 wherein said striker is made of a hard metal.

14. A glove as claimed in claim 13 wherein said striker is made of stainless steel.

15. A glove as claimed in claim 10 wherein said mounting means mounts said striker to said palm portion such that said striker is loosely held to said palm portion.

16. A glove as claimed in claim 15 wherein said striker is shaped as a cylinder with a longitudinal aperture, and wherein said mounting means includes a flexible strap passing through said longitudinal aperture and secured to said palm portion.

17. A glove as claimed in claim 10 and further including a hard backer attached to an opposite side of said palm portion adjacent said striker.

18. A glove as claimed in claim 12 wherein said striker is a hard metallic cylinder having a longitudinal aperture, and wherein said mounting means includes a flexible loop passing through said longitudinal aperture and secured to said palm portion; and further including a hard backer attached to an opposite side of said palm portion adjacent said striker.

19. A method for signalling under water by a scuba diver comprising the steps of:

attaching a discrete hard striker to a flexible article with at least a top portion of said striker being exposed;

wearing of the flexible article on a hand of a diver such that the striker is positioned in a distal area of a palm of the diver; and tapping of the striker directly against an air tank worn by the diver to produce a percussive sound.

20. A method for signalling as claimed in claim 19 wherein the striker is a corrosion resistant, hard cylinder with a central longitudinal aperture; and wherein said attaching step includes the steps of passing a flexible strap through the aperture and securing the flexible strap to the flexible article.

* * * * *